US008075185B2

(12) United States Patent
Hecht et al.

(10) Patent No.: US 8,075,185 B2
(45) Date of Patent: Dec. 13, 2011

(54) ORIGINAL CHRISTMAS TREE TRANSPORT SYSTEM

(76) Inventors: Steven F. Hecht, Jersey City, NJ (US); Kenneth C. Phalen, Jersey City, NJ (US)

( * ) Notice: Subject to any disclaimer, the term of this patent is extended or adjusted under 35 U.S.C. 154(b) by 2670 days.

(21) Appl. No.: 10/453,335

(22) Filed: Jun. 3, 2003

(65) Prior Publication Data

US 2011/0110614 A1 May 12, 2011

(51) Int. Cl.
*B65D 33/06* (2006.01)

(52) U.S. Cl. ..... 383/16; 383/4; 383/6; 383/123; 280/18

(58) Field of Classification Search ..... 206/423; 294/149, 150; 383/4, 6, 16, 123; 150/154; 47/84; 280/18; 224/158, 184
See application file for complete search history.

(56) References Cited

U.S. PATENT DOCUMENTS

| | | | | | |
|---|---|---|---|---|---|
| 1,318,652 | A | * | 10/1919 | Farkas | 383/66 |
| 2,781,811 | A | * | 2/1957 | Dilar et al. | 206/423 |
| 2,789,571 | A | * | 4/1957 | Kurman | 135/34.2 |
| 3,222,080 | A | * | 12/1965 | Kinraide | 280/18 |
| 3,249,140 | A | | 5/1966 | Jackson | |
| 3,872,906 | A | | 3/1975 | Bolanz | |
| 4,054,166 | A | | 10/1977 | Burke | |
| 4,173,351 | A | * | 11/1979 | Hetland | 280/19 |
| 4,206,795 | A | | 6/1980 | Regan | |
| 4,254,900 | A | * | 3/1981 | Wheeler | 224/158 |
| 4,283,068 | A | * | 8/1981 | Keyser | 280/19 |
| 4,301,920 | A | * | 11/1981 | Boggs | 206/315.1 |
| 4,384,604 | A | | 5/1983 | DeLaura | |
| 4,442,557 | A | * | 4/1984 | Clemens | 5/625 |
| 4,620,396 | A | * | 11/1986 | Bjorntwedt | 52/3 |
| 4,799,520 | A | | 1/1989 | Blackburn | |
| 4,899,878 | A | | 2/1990 | Lofton | |
| 4,969,555 | A | * | 11/1990 | Fitzgerald | 206/423 |
| 5,291,999 | A | | 3/1994 | Phair | |
| 5,323,558 | A | | 6/1994 | Baumler | |
| 5,352,007 | A | * | 10/1994 | Kirsch | 294/149 |
| 5,590,775 | A | | 1/1997 | Moore | |
| 5,746,317 | A | | 5/1998 | Turner | |
| D411,918 | S | | 7/1999 | Neuman | |
| D469,609 | S | * | 2/2003 | Hoffman | D3/301 |
| 7,160,588 | B2 | | 1/2007 | Sanford | |
| D565,294 | S | | 4/2008 | Limber | |
| D572,481 | S | * | 7/2008 | Metzger et al. | D3/299 |
| 7,422,220 | B2 | * | 9/2008 | Walkingshaw et al. | 280/18 |
| 7,694,494 | B2 | * | 4/2010 | Bornemeier et al. | 53/396 |
| 2003/0159958 | A1 | * | 8/2003 | Falk | 206/423 |
| 2004/0101213 | A1 | * | 5/2004 | McDonough | 383/4 |
| 2004/0262183 | A1 | * | 12/2004 | Gildart | 206/423 |
| 2005/1018397 | | | 8/2005 | Stein | |
| 2007/0278754 | A1 | * | 12/2007 | Walkingshaw et al. | 280/20 |

* cited by examiner

*Primary Examiner* — Nathan J Newhouse
*Assistant Examiner* — Peter Helvey
(74) *Attorney, Agent, or Firm* — Michael E. Zall

(57) ABSTRACT

A Christmas tree transport system formed of a folding polyethylene plastic sheet tarpaulin apparatus which allows a user to easily enclose and transport a Christmas tree. The apparatus fastens with VELCRO brand hook and loop fasteners, and allows the user to place a natural Christmas tree within the apparatus without spilling the needles. The re-useable apparatus includes attached handles and wheels, allowing a user to quickly and easily enclose and move the Christmas tree. After use, the Christmas tree transport system folds compactly to store in a small space.

5 Claims, 5 Drawing Sheets

ORIGINAL CHRISTMAS TREE TRANSPORT SYSTEM

FIELD OF THE INVENTION

The present invention relates to a Christmas tree transport bag and more particularly pertains to placing a Christmas tree within the apparatus to aid the user in transporting the tree.

DESCRIPTION OF THE PRIOR ART

Christmas tree disposal bags are widely known in the prior art. Natural Christmas trees are commonly bulky and heavy and are also prone to shed sharp needles and drip sap. These properties are likely to cause damage to walls, floors or furniture during the process of transporting the tree to and from a display area. Persons transporting the tree are commonly injured while handling the tree. The prior art only partially addresses these problems.

By way of example, the prior art discloses in U.S. Pat. No. 5,746,317 to Turner an evacuative Christmas tree container.

U.S. Pat. No. 5,590,775 to Moore discloses a Christmas tree transport and storage satchel.

U.S. Pat. No. 5,323,558 to Baumler discloses a Christmas tree skirt and container and floor protector.

U.S. Pat. No. 5,291,999 to Phair discloses a Christmas tree bag.

U.S. Pat. No. 4,899,878 to Lofton discloses a Christmas tree disposal bag.

U.S. Pat. No. 4,799,520 to Blackburn discloses a cover for Christmas trees.

U.S. Pat. No. 4,384,604 to DeLaura discloses a Christmas tree disposal bag.

U.S. Pat. No. 4,206,795 to Regan discloses a stored collapsible bag for extension about a tree for disposal of that tree.

U.S. Pat. No. 4,054,166 to Burke discloses a Christmas tree cover.

U.S. Pat. No. 3,872,906 to Bolanz discloses a Christmas tree cover.

Widely available Christmas tree bags are made of thin plastic which may easily rip and spill needles. Strong sharp branches frequently poke through flimsy plastic and may injure the user. In addition, most Christmas tree bags are not re-useable and are non-biodegradable. Christmas tree bags that are strong enough to re-use are unsightly, bulky and difficult to store. Each of the examples above suffers from one or more of these disadvantages.

It is therefore an object of the present invention to provide an inexpensive but lightweight and water-resistant transport system, in which a tarpaulin fastens with strips of synthetic hook and loop materials that adhere when pressed together, commonly sold under the trademark VELCRO®(Velcro Ind., BV) in order to avoid use of unwieldy buckles, straps, zippers and ropes.

It is a further object of the present invention to provide a Christmas tree transport system which is durable enough to be re-useable, but is also thin and light to allow for easy storage.

It is a further object of the present invention to provide a Christmas tree transport system equipped with wheels, swivel casters or other rolling means and a front handle which allows one person to easily maneuver and transport a Christmas tree to or from the home with no heavy lifting and a second handle or set of handles to allow two persons to easily carry the tree.

SUMMARY

The present invention is directed to an apparatus that satisfies this need. In accordance with these and other objects, the present invention is a Christmas tree transport system, which comprises a rectangular tarpaulin fabricated of strong woven nylon strands coated on both sides with polyethylene film. A strip of red hook and loop fastener system material is sewn to the bottom and right outer edges viewed from the top, see FIG. 1, and to the right outer edge as viewed from the bottom, see FIG. 2. Additional hook and loop fastener strips are sewn in the locations shown in FIGS. 1 and 2. Rolling means are attached to a plate which is attached to the tarpaulin. A handle is attached to the front top edge to facilitate transport. A secondary handle or set of handles is attached to the rear to allow for lifting by two persons.

After placement of the Christmas tree on the tarpaulin, the left side of the tarpaulin is folded as shown in FIG. 5, and the right edge is folded until the hook and loop fastener strip edges may be attached. The bottom edge of the tarp is then folded up as in FIG. 6, and attached to the hook and loop fastener strips on the bottom to enclose the tree within a sack. The user may then easily maneuver the Christmas tree transport system to move the Christmas tree from one place to another.

DESCRIPTION OF THE PREFERRED EMBODIMENT

Figure 2:
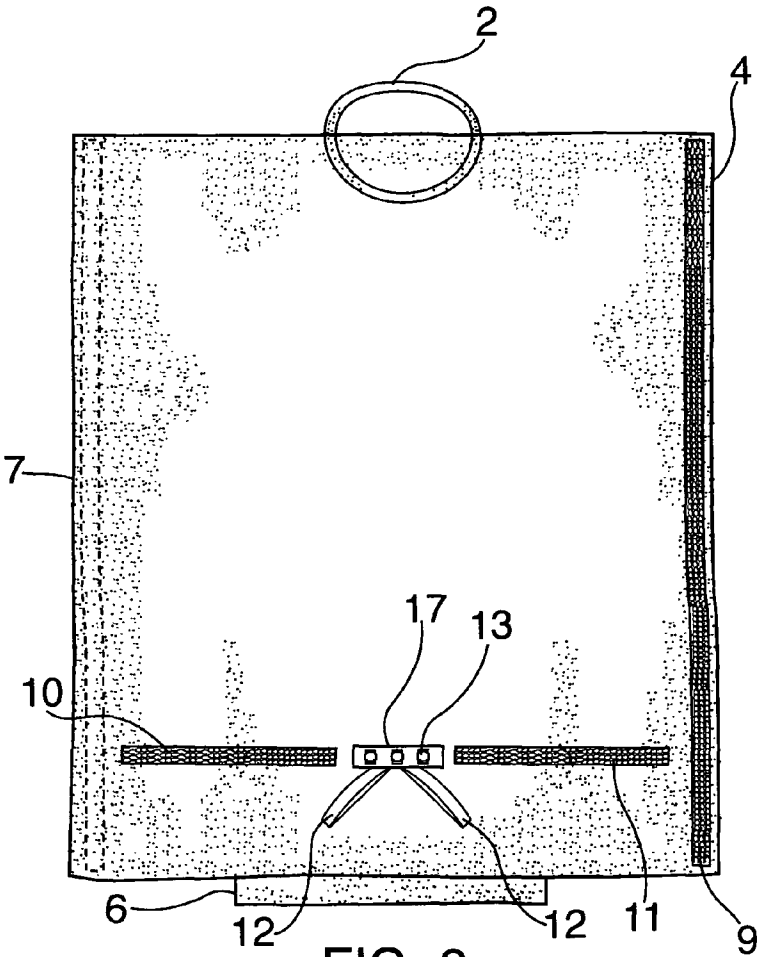
FIG. 2 is a bottom plan view of the Christmas tree transport system.
Figure 1:
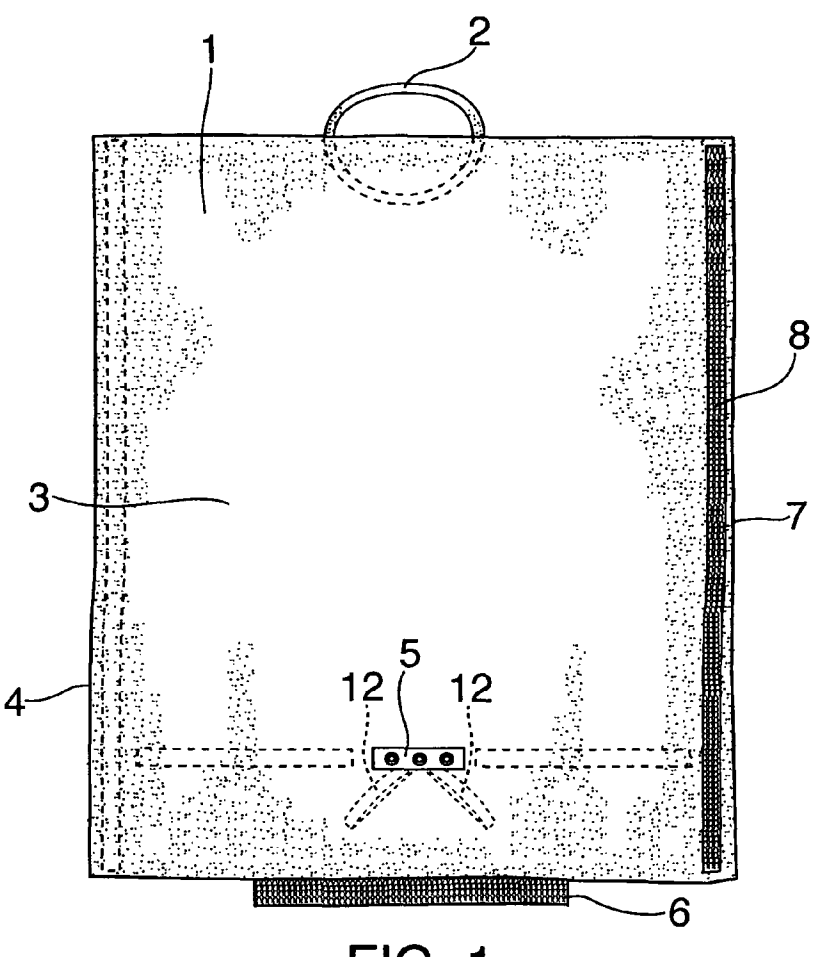
FIG. 1 is a top plan view of the Christmas tree transport system according to the invention.

The preferred embodiment of the Christmas tree transport system is shown in the exemplary drawings, FIGS. 1 through 9. FIGS. 1 and 2 show top and bottom plan views, respectively, of the present invention, generally designated by the reference numeral 1, in its unfolded configuration.

A flexible flat sheeting material, referred to herein as a tarpaulin or tarp 3, fabricated of strong woven nylon strands coated on both sides with polyethylene film, is formed in a rectangular shape with first side edge 4, a second side edge 7 a front edge and a rear edge as shown in FIGS. 1 and 2. Each side edge extends along the entire length of the tarp. A hook and loop fastener strip 9 is affixed to the top along the first side edge and another hook and loop fastener strip 8 is affixed to the bottom along the second side edge 7. A front handle 2 is affixed to the front edge of the tarp and a secondary handle or set of handles 12 is affixed to the bottom of the tarp as shown in FIG. 2.

Figure 3:
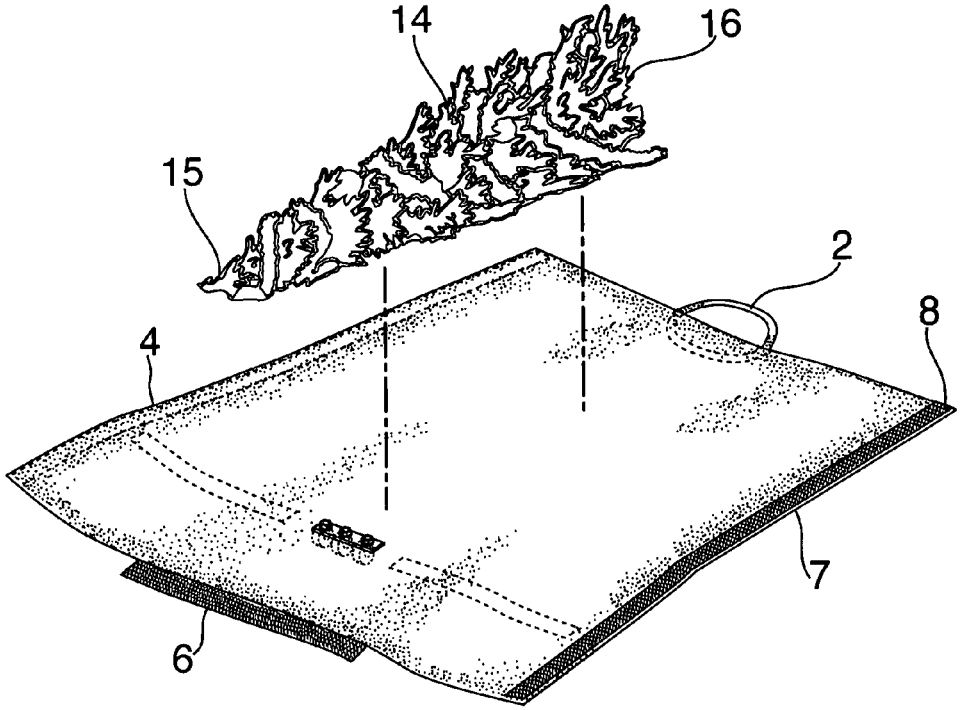
FIG. 3 is a perspective illustration of the top of the Christmas tree transport system to show a Christmas tree in the process of being placed upon it.
Figure 4:
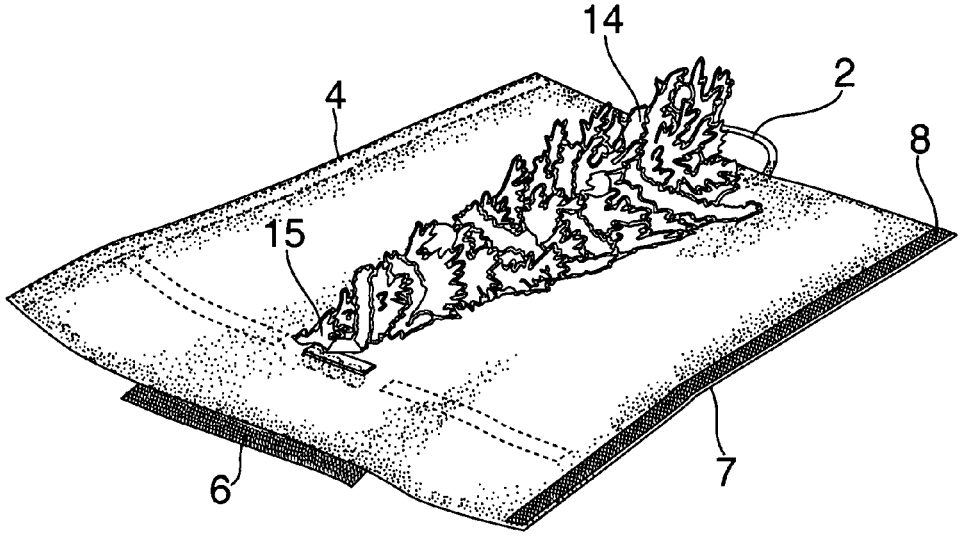
FIG. 4 is a perspective illustration of the top of the Christmas tree transport system to show a Christmas tree in place upon it.
Figure 5:
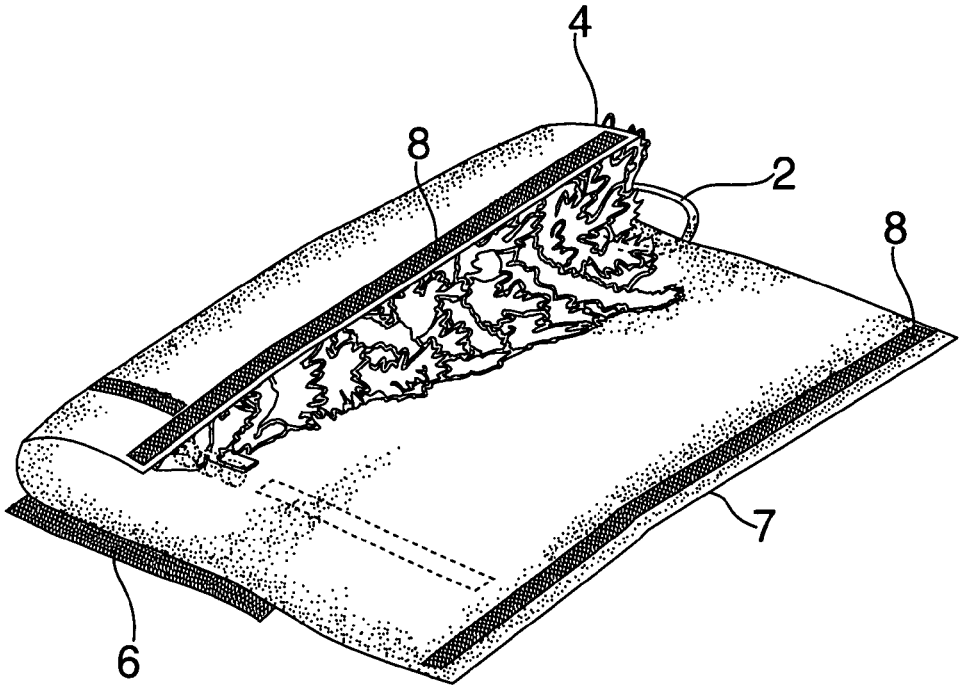
FIG. 5 is a perspective illustration of the top of the Christmas tree transport system to show the left side folded over the tree.
Figure 6:
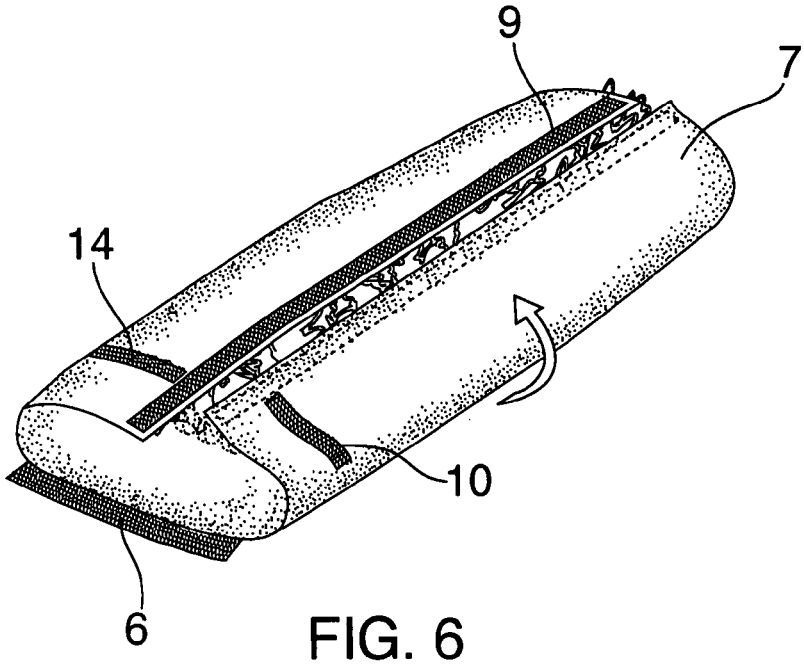
FIG. 6 is a perspective illustration of the top of the Christmas tree transport system to show the right side folded over to enclose the tree.
Figure 7:
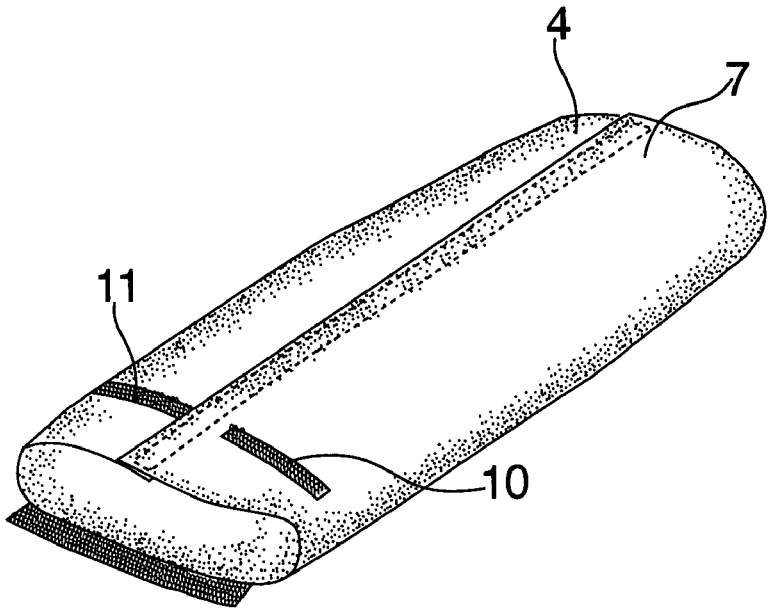
FIG. 7 is a perspective illustration of the top of the Christmas tree transport system to show the right and left sides folded over and the hook and loop fastener strip on the bottom outer edge of the left side joined to the hook and loop fastener strip on the upper outer edge of the right side to enclose the tree.
Figure 8:
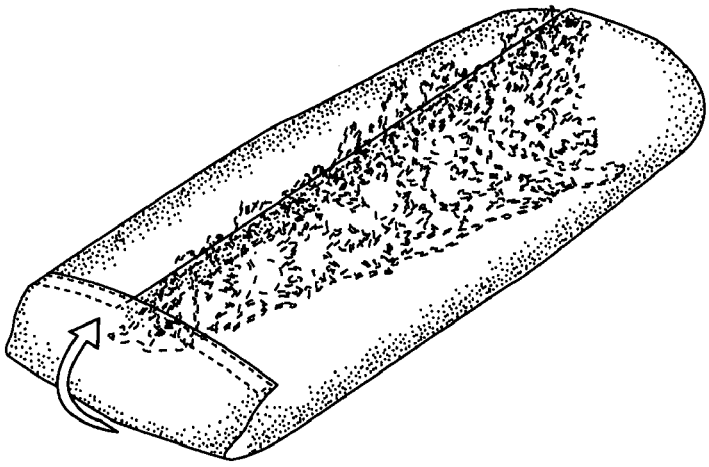
FIG. 8 is a perspective illustration of the top of the Christmas tree transport system showing the back flap folded up and the hook and loop fastener strip on the back flap joined to the hook and loop fastener strip on the top to enclose the tree.
Figure 9:
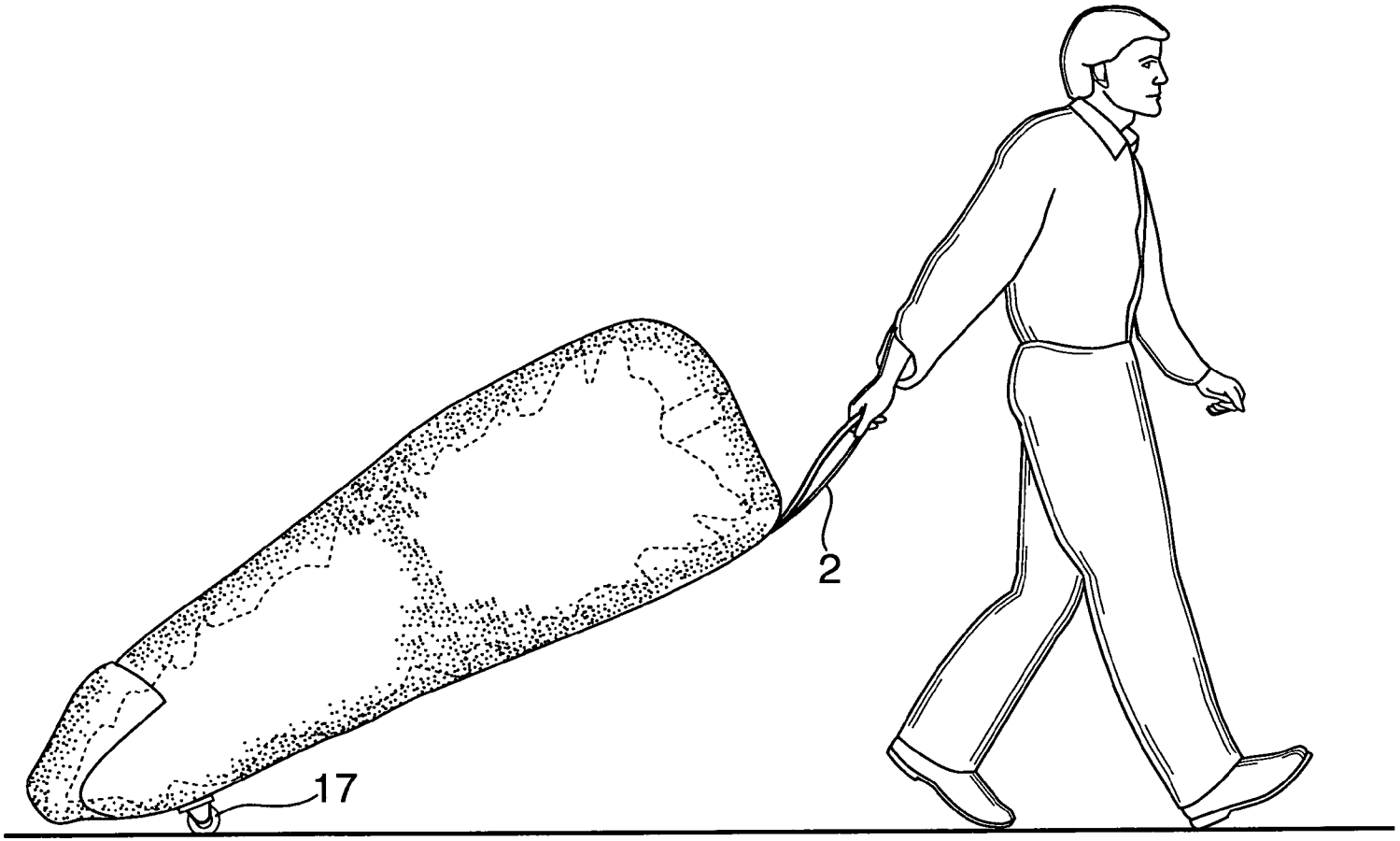
FIG. 9 is a perspective illustration from the side showing the Christmas tree transport system in the process of transporting the tree. The user is pulling the Christmas tree remover by the front handle as it rolls on the attached wheels.

To utilize the present invention, the tarp 3 is laid upon the ground or a floor surface as shown in FIG. 1. As shown in FIGS. 3 and 4, a Christmas tree is placed in the center of the tarp 3, with the point of the tree 15 oriented to the rear of the tarp and the stump 16 oriented to the front of the tarp. The first side edge 4 is folded over the tree as shown in FIG. 5. The second side edge 7 is then folded over the tree as shown in FIG. 6. The tree is enclosed as shown in FIG. 7 by coupling the second side edge hook and loop fastener strip 8 to the first side edge hook and loop fastener strip 4. The tree 14 is further enclosed by coupling the rear flap hook and loop fastener strip 6 to hook and loop fastener strips 10 and 11. The present invention 1 may then be transported by pulling on the front handle 2 while the Christmas tree transport system 1 rolls on rolling means 17. Alternatively, a second user may lift the rear handle 12 while the primary user lifts the front handle 2 and the present invention may be carried to a desired location.

LIST OF REFERENCE NUMBERS

1. Christmas Tree Transport System
2. Front Handle
3. Tarpaulin
4. First Side Edge
5. Top Attachment Plate
6. Rear Flap hook and loop fastener Strip
7. Second Side Edge
8. Second Side Edge hook and loop fastener Strip
9. First Side Edge hook and loop fastener Strip
10. Rear Left hook and loop fastener Strip
11. Rear Right hook and loop fastener Strip
12. Rear Handle(s)
13. Bottom Attachment Plate
14. Christmas Tree
15. Christmas Tree Point
16. Christmas Tree Stump
17. Rolling Means The foregoing description of the Christmas tree transport system is set forth as a specific embodiment, but it should be understood that modifications in the arrangement, number and detailed structure of the parts may be resorted to without departing from the essence, spirit or scope of the present invention.

What is claimed is:

1. A Christmas tree transport system comprising:

(a) flexible flat sheeting material having a rectangular shape;

(b) said material having two linear side edges, a linear bottom edge and a linear top edge;

(c) means for removably fastening together the linear side edges comprising a strip of hook and loop fasteners affixed along the entire length of each of the said side edges such that when the side edges are folded over each other so that the edges meet, the side edges removably fasten to each other enclosing the tree;

(d) means for removably fastening the linear bottom edge to the body of the sheeting material comprising a lower horizontal strip of hook and loop fastener affixed to the sheeting material approximately one quarter of the total length above the linear bottom edge;

(e) means for removably fastening the linear bottom edge to the body of the sheeting material comprising a strip of hook and loop fastener affixed along the entire length of the linear bottom edge such that when the bottom edge is folded up, the bottom edge removably fastens to the lower horizontal strip of hook and loop fastener thus enclosing the point of the tree;

(f) an attachment plate of a rigid substance mounted to the sheeting material in the location of the lower horizontal strip;

(g) rolling means mounted to the attachment plate to permit rolling the Christmas tree transport system when a cut down evergreen tree is enclosed;

(h) a strip of cloth affixed to the linear front edge to form a front handle;

(i) one or more strips of cloth formed into loops attached to the sheeting material at the attachment plate in order to form a rear handle.

2. The Christmas tree transport system as recited in claim 1, wherein the rolling means is a plurality of casters.

3. The Christmas tree transport system as recited in claim 1, wherein the rolling means is a plurality of wheels.

4. The Christmas tree transport system as recited in claim 1, wherein the attachment plate is metal.

5. The Christmas tree transport system as recited in claim 1, wherein the attachment plate is plastic.

* * * * *